US005125600A

United States Patent [19]

Brumbaugh

[11] Patent Number: 5,125,600

[45] Date of Patent: Jun. 30, 1992

[54] REMOVABLE RADOME COVER

[75] Inventor: Charles T. Brumbaugh, Fullerton, Calif.

[73] Assignee: Rockwell International Corporation, Seal Beach, Calif.

[21] Appl. No.: 709,270

[22] Filed: Jun. 3, 1991

[51] Int. Cl.[5] ..... B64D 7/00

[52] U.S. Cl. ..... 244/158 A; 244/121

[58] Field of Search ..... 244/158 A, 117 R, 117 A, 244/119, 121, 3.25, 3.27, 118.2

[56] References Cited

U.S. PATENT DOCUMENTS

| | | | |
|---|---|---|---|
| 3,536,011 | 10/1970 | Kinnaird et al. | 244/158 A |
| 3,970,006 | 7/1976 | Copeland et al. | 244/158 A |
| 4,186,900 | 2/1980 | Loeb, Jr. | 244/158 A |

*Primary Examiner*—Sherman Basinger
*Assistant Examiner*—Virna Lissi Mojica
*Attorney, Agent, or Firm*—H. Fredrick Hamann; George A. Montanye; Tom Streeter

[57] ABSTRACT

The removalbe radome cover shown here is suitable for protecting the radome at the nose of a high speed missile before the radar is turned on. An outer layer lies over, but is not bonded to, an inner layer, and is divided into longitudinal sheets by tear lines. When the radar is to be turned on, a pyrotechnic device at the nose of the radome drives a piston-operated cone forward. Knives on the outside of the cone start to tear the tear lines. The cone lifts the sheets from the inner layer. A spreader lies under each sheet and, rotated by the piston, spreads the sheet further from the inner layer. Air catches the sheets and tears then back to the base of the nose cone. A metal strip along the center of each sheet prevents it from disintegrating before being fully torn back, and provides an engaging surface for the spreader. Thus, only the inner layer will be presented to the radar after the radar is turned on.

16 Claims, 4 Drawing Sheets

REMOVABLE RADOME COVER

This invention was made with Government support under Contract No. DASG60-87-C-0031 awarded by the Army. The Government has certain rights in this invention.

BACKGROUND OF THE INVENTION

The present invention relates to radome covers; and has particular relation to such covers which may be easily removed when the radar within the radome is to be operated.

A radome protects a radar from environmental hazards, but may itself be damaged by such hazards. The damage may be insufficient to threaten the radar itself, but the inhomogeneity of the radome that result from heat or damage will interfere with the effectiveness of the radar since the radome will now differentially diffract the radar beam. It is therefore desirable to protect the radome, when the radar is not in use, with a cover which will absorb the heat and other damage which otherwise would be inflicted on the radome. However, removing a radome cover is difficult and tedious, especially on short notice.

SUMMARY OF THE INVENTION

The present invention makes removal of the radome cover quick and easy, and is especially adapted to missile radar, since it takes advantage of airflow to help remove the radome cover. A pyrotechnic charge is placed at the nose of the radome to drive knives and spreaders. These in turn tear the cover at its nose. Airflow then tears the cover from the radome along preestablished tear lines. The present invention is particularly adapted to the radome on a high speed missile, since the missile will typically achieve velocities that will significantly heat the radome, thereby rendering the missile's radar less accurate. In accordance with the present invention, the radome cover is removed prior to activation of the radar. This occurs when the target comes in range of the radar, which may be shortly, or long, after the missile is launched. This allows maximum accuracy for the maximum period of time when the radar is on.

It is an objective of the present invention to provide a radome cover which may be removed entirely by airflow, without external equipment, and without interfering with the operation of the radar itself.

It is a feature of the present invention that it may be remotely actuated by an electrical signal.

It is an advantage of the present invention that such actuation may take place before the turning on of the radar and after the launch of the missile.

BRIEF DESCRIPTION OF THE DRAWINGS

These and other objectives, features, and advantages are apparent in the drawings, in which.

DETAILED DESCRIPTION OF A PREFERRED EMBODIMENT

Figure 1:
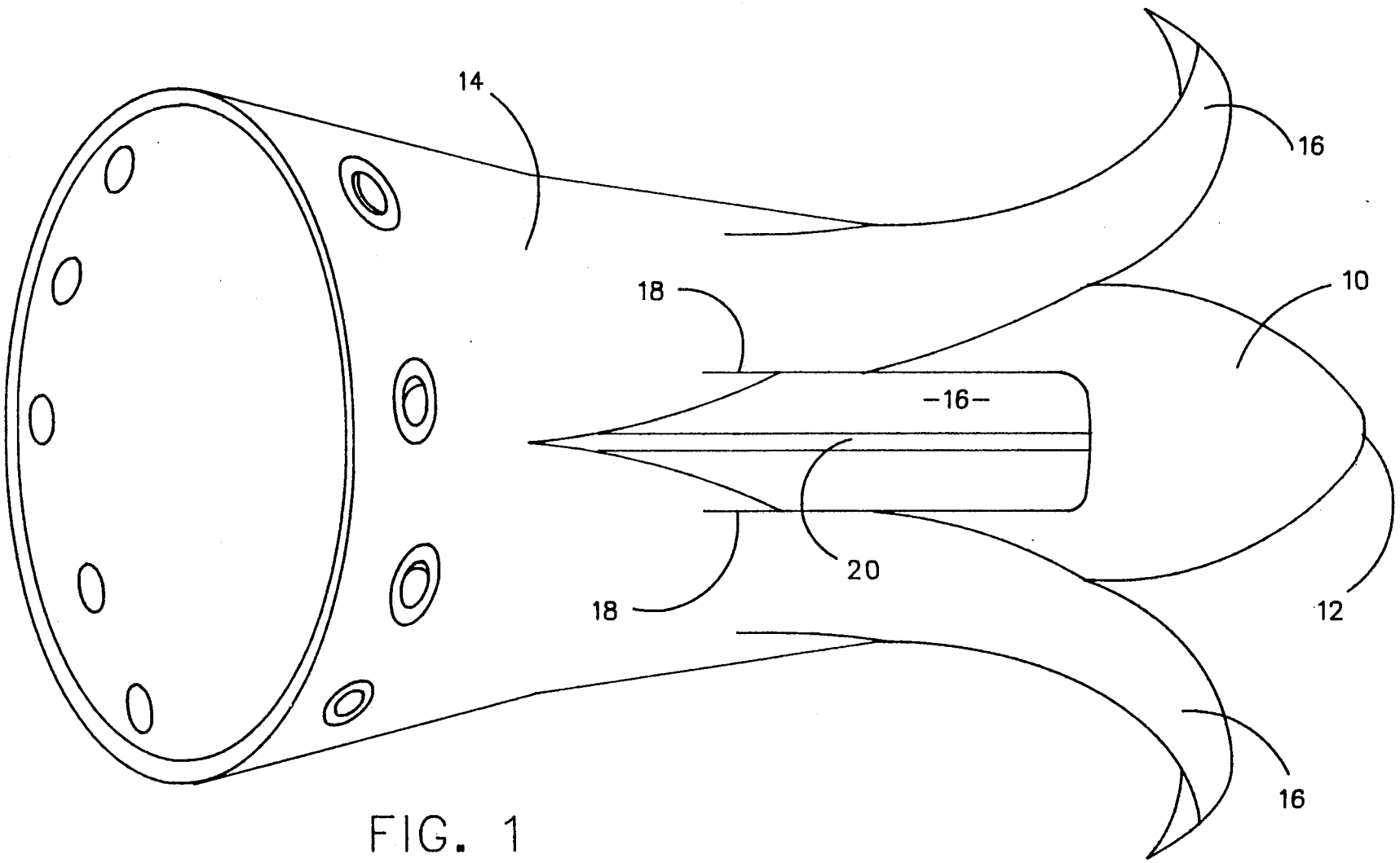
FIG. 1 is a perspective view of the present invention on a radome, in the process of being removed from it.

In FIG. 1, a radome 10 with a nose 12 is covered by a radome cover 14. The cover 14 has begun to tear apart into longitudinal sheets 16, which are separated from one another by longitudinal tear lines 18. A metal strip 20 prevents the sheets 16 from disintegrating prematurely, and acts as a surface which may be engaged by the actuator 22 (FIG. 2) at the nose 12 of the radome 10. The cover 14 is a Teflon/microfiber combination such as that sold under the DUROID name by Norton Corporation. DUROID is relatively soft and is ablative. Ablation allows the cover to handle the high heat generated as the missile goes through the air at high velocities. Since the DUROID is soft it does not damage the missile when it is deployed.

Figure 2:
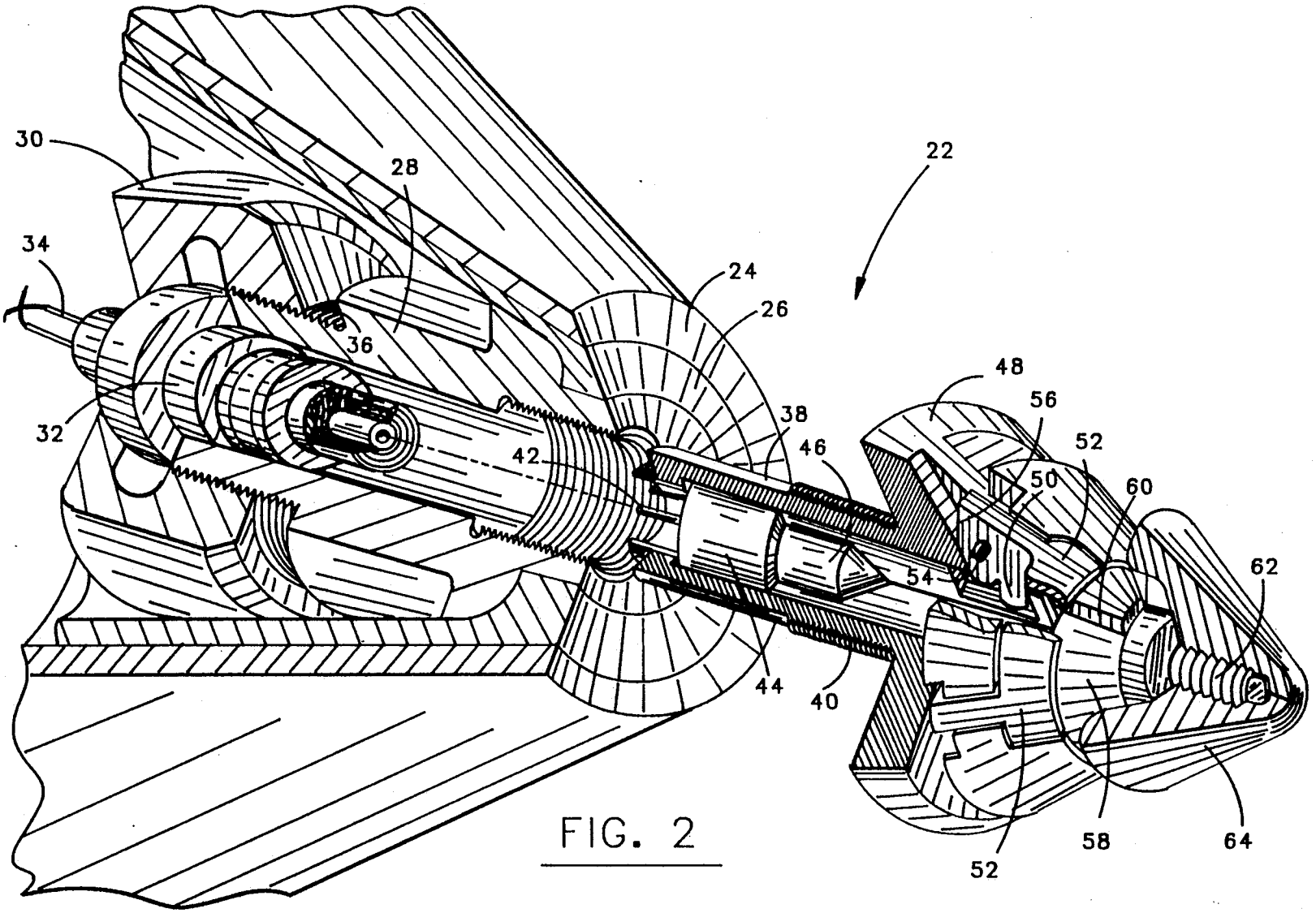
FIG. 2 is an exploded, partly cut away view of the actuator of the present invention.

In FIG. 2, the actuator 22 is shown in an exploded view, partly cut away. The cover 14 has been removed. The radome 10 used in this embodiment is seen to comprise two layers, an outer layer 24 and an inner layer 26. The outer layer 24 is also a Teflon/microfiber combination, such as DUROID. The electrical properties of DUROID are not significantly affected by limited heating. After the cover 14 has been removed, airflow will heat and/or ablate the outer layer 24 (and therefore distort radar beams) somewhat, but not nearly to the extent that would have occurred if the cover 14 had been allowed to remain over the radome 10. In that situation, the extensive heating and/or ablation caused by extended high speed airflow would seriously interfere with radar accuracy.

The inner layer 26 must be supportive of the ablative layer 24, and must retain its shape well under the high pressures created by the high airflow. It is preferably composed of quartz bismalgimide. Both quartz bismalgimide and DUROID are transparent to radar waves. The radome 10 may be composed of other materials, but must be rigid, able to handle heat, and be transparent to radar waves.

Figure 3:
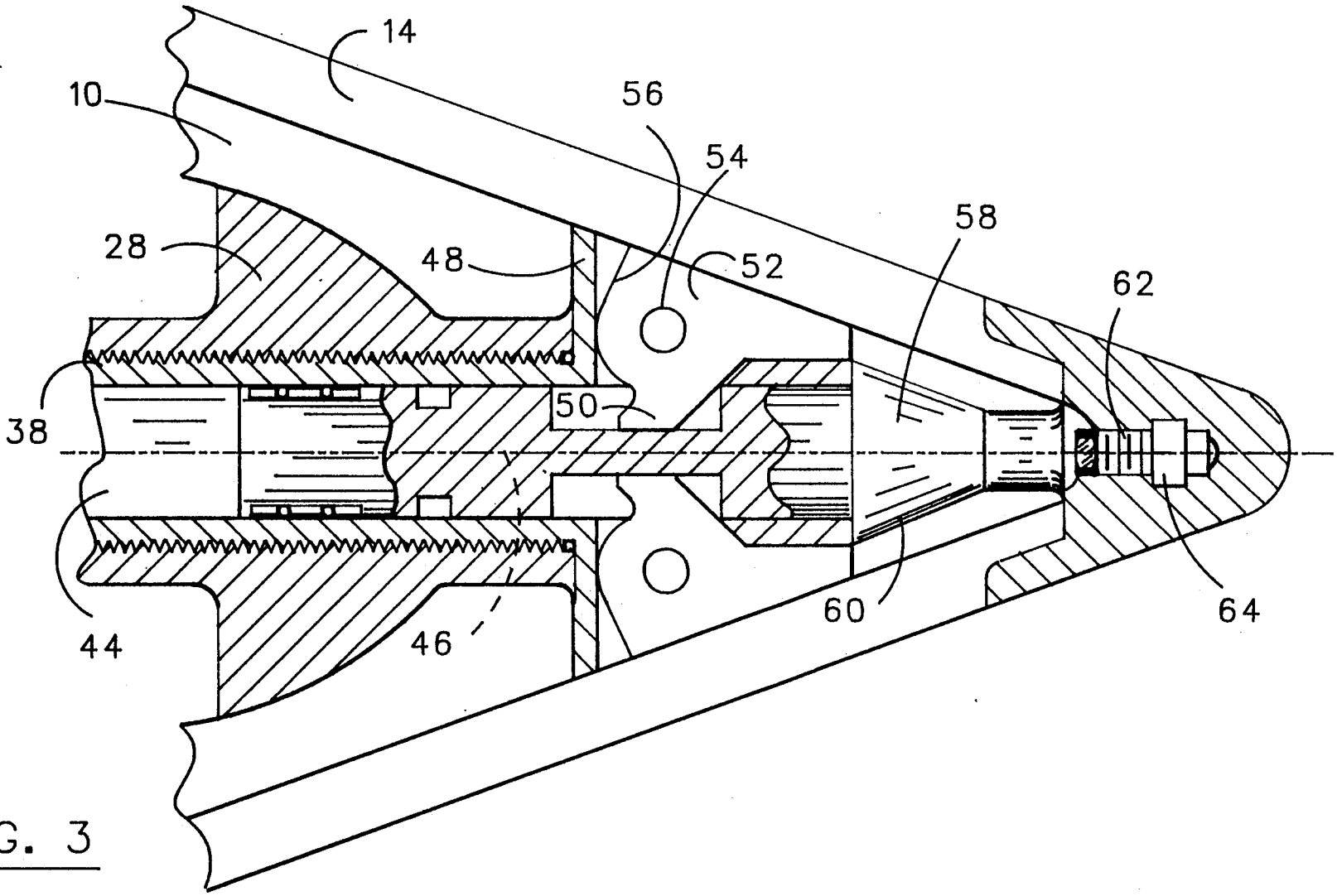
FIG. 3 is an axial cross-section of the actuator shown in FIG. 2, before actuation.

An outer cylinder 28 fits into the rear end of the nose 12, and is covered at its rear end by a plug 30. The plug 30 retains a connector 32 which is connected to a firing circuit through wires 34. Threads 36 are the preferred way of joining the plug 30 to the outer cylinder 28, but other joining methods may be used if desired. An inner cylinder 38 screws into the outer cylinder 28 by means of threads 40. The inner cylinder 38 contains an igniter 42 and a pyrotechnic charge 44. A piston 46 slides in the inner cylinder 38. The inner cylinder 38 terminates at its forward end in an annulus 48, which engages on its rear surface the forward surface of the outer layer 24, the inner layer 26, and the outer cylinder 28, thereby binding together the entire actuator 22 to the nose 12 of the radome 10 as shown in FIG. 3.

Figure 4:
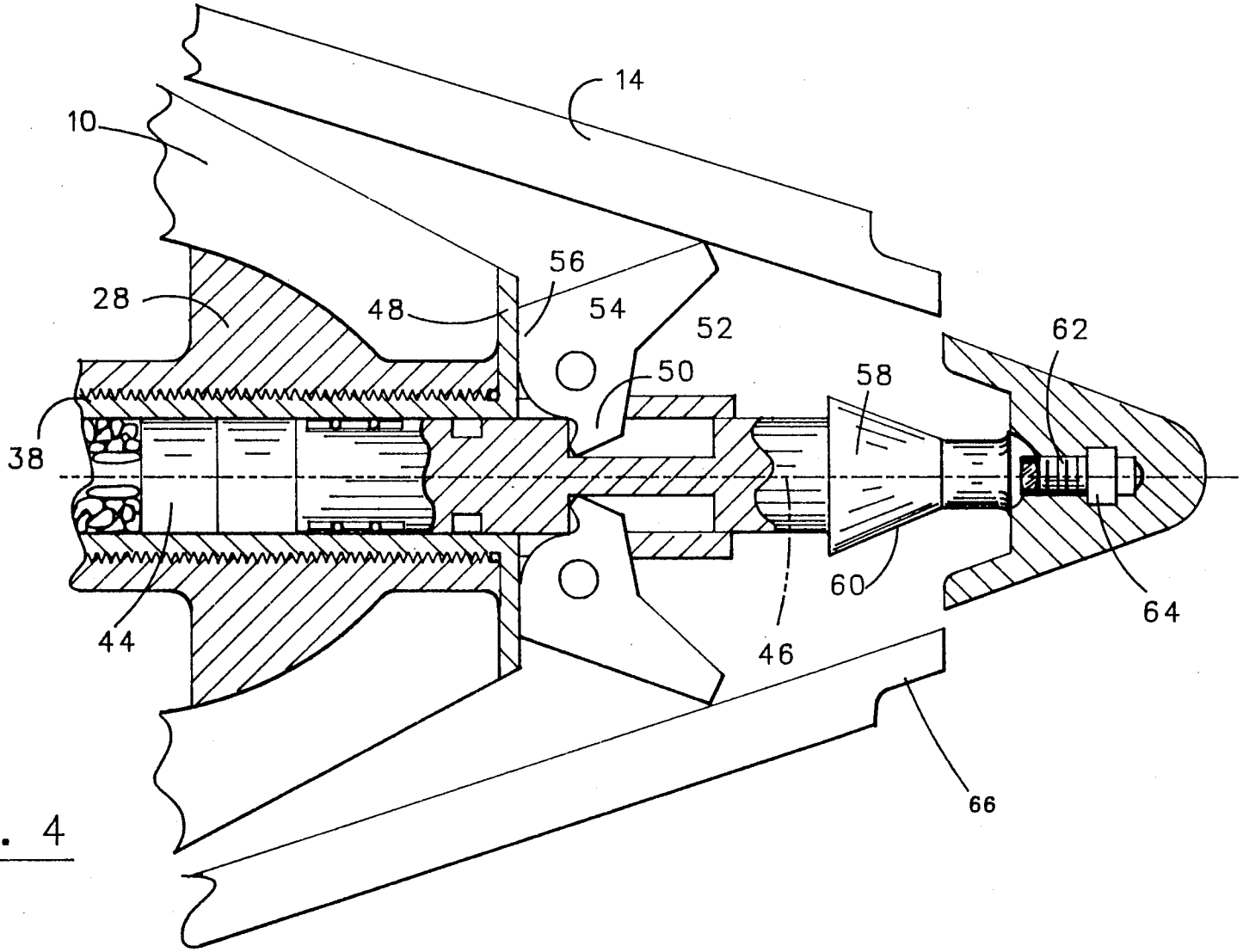
FIG. 4 is an axial cross-section of the actuator shown in FIG. 2, after actuation.

When the pyrotechnic charge 44 explodes, it drives the piston 46 forward and against the tangs 50 of a plurality of spreaders 52 which rotate on pivots 54. As seen in FIG. 4, this spreads the spreaders 52 radially outwardly, thereby separating the cover 14 from the radome 10. The rear surface 56 of the spreader 52 engages the annulus 48. At the same time, tang 50 engages inner cylinder 38, thereby preventing further rotation of the spreader 52, which prevents further rotation of the tang 50, which prevents further forward motion of the piston 46.

The piston 46 terminates in a cone 58. Knives 60 are located on the surface of the cone 58, and engage respective tear lines 18 of the cover 14. The cone 58 terminates in a screw 62, onto which a cap 64 may be screwed. The cap 64 engages a recess 66 of the cover 14, so as to prevent the cover 14 from prematurely tearing off from the radome 10.

Operation is apparent from the foregoing description. Before the pyrotechnic charge 44 is detonated, the cap 64 holds the cover 14 onto the radome 10. When the pyrotechnic charge 44 is detonated, it drives the piston 46 forward, rotating the spreaders 52 and driving the cone 58 forward. The cap 64 no longer engages the recess 66, allowing the cone 58 to spread the forward edge of the cover 14. At the same time, the knives 60 engage the tear lines 18 of the cover 14, beginning the tear. This tearing is accentuated by the spreaders 52, which engage the metal strips 20 to spread the cover 14 even further from the radome 10. By this time, sufficient air flow has gotten between the cover 14 and the radome 10 as to tear the cover 14 into strips 16, and to pull them to the rear of the radome 10. From there, they are torn completely off and fall to the ground.

The actuator 22 remains affixed to the nose 12 of the radome 10. It presents a small interference with the radar beam passing through the radome 10, but this interference is more easily dealt with than the effects of heat or erosion. It is important that the cone 58 and cap 64 not be ejected from the radome 10, since, typically, the pyrotechnic charge 44 is detonated when the missile is traveling at a high velocity. If any debris were allowed to separate from the actuator 22, the missile would likely run into it, thereby causing damage to the missile or radome.

INDUSTRIAL APPLICABILITY

The present invention is capable of exploitation in industry, and can be used, whenever it is desired to provide a radome cover which can be removed without external apparatus, simply by airflow. It can be made from elements which, taken separately and apart from one another, may be entirely conventional, or it may be made from their nonconventional counterparts.

While a particular embodiment of the present invention has been described herein, the true scope and spirit of the invention is not limited thereto, but is limited only by the appended claims.

What is claimed is:

1. A cover for a radome and apparatus for removing the cover from the radome, the radome having a nose, the cover and apparatus comprising:

(a) a tearable and soft layer covering the radome, the layer including a plurality of longitudinal tear lines defining longitudinal tear sheets;

(b) a cone slidably affixed to the nose of the radome;

(d) a plurality of spreaders rotatably affixed to the nose of the radome, each spreader engaging a respective tear sheet; and (e) means for driving the cone forward and for rotating the spreaders.

2. The cover and apparatus of claim 1, further comprising a plurality of knives affixed to the cone, each knife engaging a respective tear line.

3. The cover and apparatus of claim 1, wherein the driving and rotating means comprises a pyrotechnically operated piston.

4. The cover and apparatus of claim 3, further comprising a plurality of knives affixed to the cone, each knife engaging a respective tear line.

5. The cover and apparatus of claim 1, further comprising means for stopping the spreaders after the spreaders have been rotated.

6. The cover and apparatus of claim 5, further comprising a plurality of knives affixed to the cone, each knife engaging a respective tear line.

7. The cover and apparatus of claim 5, wherein the driving and rotating means comprises a pyrotechnically operated piston.

8. The cover and apparatus of claim 7, further comprising a plurality of knives affixed to the cone, each knife engaging a respective tear line.

9. The cover and apparatus of claim 1, further comprising means for stopping the cone after it has been driven forward.

10. The cover and apparatus of claim 9, further comprising a plurality of knives affixed to the cone, each knife engaging a respective tear line.

11. The cover and apparatus of claim 10, wherein the driving and rotating means comprises a pyrotechnically operated piston.

12. The cover and apparatus of claim 11, further comprising a plurality of knives affixed to the cone, each knife engaging a respective tear line.

13. The cover and apparatus of claim 9, further comprising means for stopping the spreaders after the spreaders have been rotated.

14. The cover and apparatus of claim 13, further comprising a plurality of knives affixed to the cone, each knife engaging a respective tear line.

15. The cover and apparatus of claim 13, wherein the driving and rotating means comprises a pyrotechnically operated piston.

16. The cover and apparatus of claim 15, further comprising a plurality of knives affixed to the cone, each knife engaging a respective tear line.

* * * * *